United States Patent [19]

Murrey, Sr.

[11] 4,205,843

[45] Jun. 3, 1980

[54] LAMINATED PIN DECK AND METHOD OF INSTALLATION

[76] Inventor: Gordon W. Murrey, Sr., 14150 S. Figueroa, Los Angeles, Calif. 90061

[21] Appl. No.: 919,487

[22] Filed: Jun. 27, 1978

[51] Int. Cl.[2] ..... A63D 1/04

[52] U.S. Cl. ..... 273/51

[58] Field of Search ..... 273/51; 52/408; 428/460

[56] References Cited

U.S. PATENT DOCUMENTS

| | | | |
|---|---|---|---|
| 2,039,580 | 5/1936 | Borders | 273/51 |
| 2,209,082 | 7/1940 | DeBay | 273/51 |
| 2,969,983 | 1/1961 | DeVore | 273/51 |

OTHER PUBLICATIONS

"Synthetic Lane Surface", Bowling Magazine, Jan. 1977, p. 6.

DBA Products Co., Inc., Advertisement, Bowling Magazine, Jun. 1977, pp. 2 and 3.

*Primary Examiner*—Anton O. Oechsle

*Attorney, Agent, or Firm*—Fulwider, Patton, Rieber, Lee & Utecht

[57] ABSTRACT

A laminated pin deck construction and a method of installing the deck construction on an existing pin deck. A barrier layer of relatively hard material overlies a wooden base and is affixed by means of adhesive and screws. A high pressure laminate material having an external surface with the appearance of a conventional bowling alley surface is adhesively affixed to the barrier layer. Installation on existing pin decks includes sanding down the original wooden layer to receive the barrier layer and laminate layer.

13 Claims, 5 Drawing Figures

LAMINATED PIN DECK AND METHOD OF INSTALLATION

BACKGROUND OF THE INVENTION

1. Field of the Invention

The present invention relates generally to bowling alley pin deck constructions and, more particularly, providing a pin deck with a hard external surface which resists pin impacts.

2. Description of the Prior Art

Bowling alleys are conventionally constructed of laminated tongue-and-groove bedstock including approach, impact lane and pin deck sections, usually using different types of wood. Since a bowling ball is seldom lofted in on the lane section, there is little danger of injury to the surface of the lane. The lane section is therefore usually constructed of a relatively inexpensive wood, such as pine.

In the pin deck section, however, the bowling ball strikes the pins with a great deal of force, throwing the pins in a random manner. Many of the pins strike the pin deck with relatively sharp edges and nicks and dents occur. To reduce denting, the pin deck is usually constructed of a hardwood, such as maple. Such a laminated tongue-and-groove hardwood bedstock pin deck is relatively expensive. However, even such hardwoods become dented and the deck surface has to be periodically resurfaced. Since the levels of the various sections must remain the same, usually the entire bowling alley must be resurfaced at great cost.

A more recent pin deck construction includes a high pressure laminate material having an external surface with the appearance of finished wood which is adhesively bound to a wooden base, the high pressure laminate being more resistant to pin impacts than the hardwood. In this type of construction, the covering laminate may be replaced when it becomes worn without incurring the inordinate expense attendant the entire lane. While this construction does provide a hard impact resistant pin deck surface, the pin impacts do tend to loosen the adhesive bond between the high pressure laminate and the wooden base, resulting in eventual separation between the two which is unacceptable. The separation of the laminate material from the wooden base is believed to be caused by the difference in hardness between the laminate and relatively soft wood.

A more serious situation arises when the high pressure laminate is installed over an original wooden base which has been dressed with an oil substance. In this case, the pin impacts cause the bed stock slats to loosen from one another and from the understructure and, further, cause oil in the original wooden base to reach the adhesive layer by capillary action, which causes deterioration of the adhesive and separation of the laminate from the wooden base.

While the high pressure laminate material with an external surface having the appearance of original wood greatly increases the life of the pin deck, there has been a need for a construction technique and method of installation of the laminate material onto a wooden base which would greatly reduce the loosening or deterioration of the adhesive layer between the laminate material and the wooden base. The present invention satisfies that need.

SUMMARY OF THE INVENTION

The present invention provides an original pin deck construction and method of installation of the pin deck on an existing wooden deck which includes a relatively rigid barrier layer between the laminate and the original wooden base which not only provides a hard impact-resisting surface for adhesively bonding the high pressure laminate to it, but also provides an oil impervious layer between the adhesive and a wooden base layer which may have been oiled.

Since the barrier layer is not the final external surface of the pin deck, it is preferably securely bound to the wooden base layer by means of adhesives and, in addition, mechanical fasteners such as screws, which are not effected by deterioration of the adhesive by oil seeping from the wooden base nor loosened by impacts. The high pressure laminate may then be adhesively bound to the hard oil-impervious barrier layer, resulting in greatly increased pin deck life.

When the pin deck construction of the present invention is installed on an existing wooden pin deck, the original wooden layer is sanded down to a level to permit the installation of the barrier layer and high pressure laminate at the original level of the deck. Thus, the original pin deck construction and method of installing the construction on an existing pin deck of the present invention results in an improved pin deck using a high pressure laminate top surface which can be securely adhesively bonded to a relatively hard oil-impervious barrier decreasing the loosening of the adhesive due to pin impact or due to deterioration of the adhesive because of oil seepage from the original wood.

DESCRIPTION OF THE PREFERRED EMBODIMENT

Figure 1:
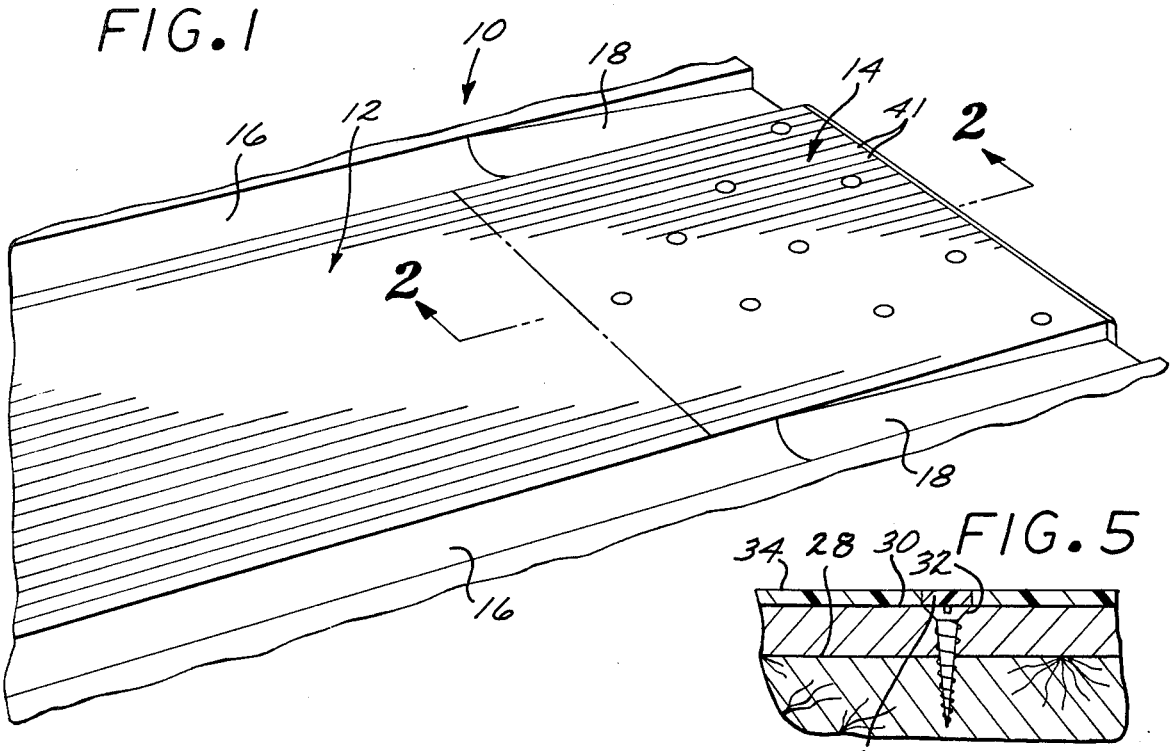
FIG. 1 is a partial perspective view of a bowling alley illustrating the position of the pin deck.

Referring now to the drawings, and particularly FIG. 1 thereof, a bowling alley 10 shown in partial perspective has a conventional lane section 12 and a pin deck section 14, the pin deck section being about five feet in length. The alley 12 includes conventional gutters 16 and gutter ends 18. In a conventional construction, the lane section 12 would be constructed of a relatively soft wood, such as pine, while the pin deck section 14 would be constructed of a hardwood, such as maple, to resist the pin impacts of the falling pins.

Figure 2:
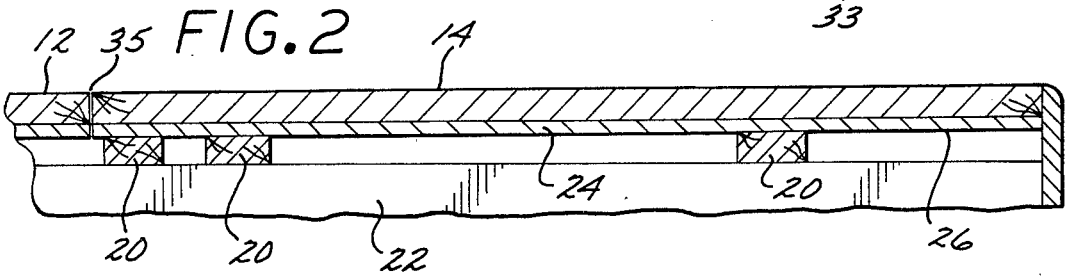
FIG. 2 is an enlarged cross sectional view of the pin deck area taken in the direction of lines 2—2 of FIG. 1.

A cross section of a conventional pin deck 14 is shown in FIG. 2, in which the deck is constructed of laminated side-by-side strips of tongue and groove hardwood which are carried on transverse stringers 20 which rest on longitudinal stringer support planks 22. A sound deadening layer 24 of about ½ inch thick which, for example, may be a commercial product such as Celutex, is sandwiched between the hardwood deck 14 and stringers 20.

Figure 3:
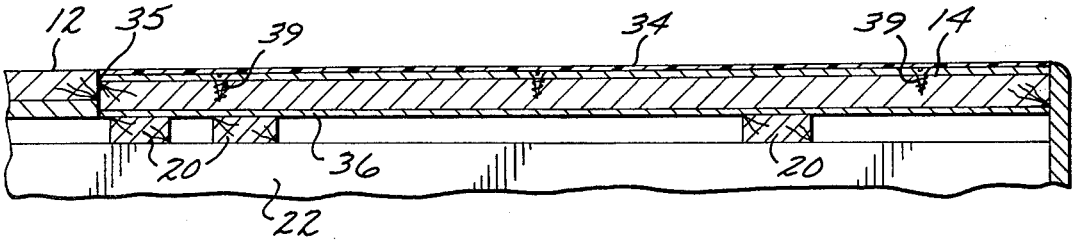
FIG. 3 is an enlarged sectional view also taken in the direction of lines 2—2 of FIG. 1 illustrating a step in the method of installation of the pin deck construction.
Figure 4:
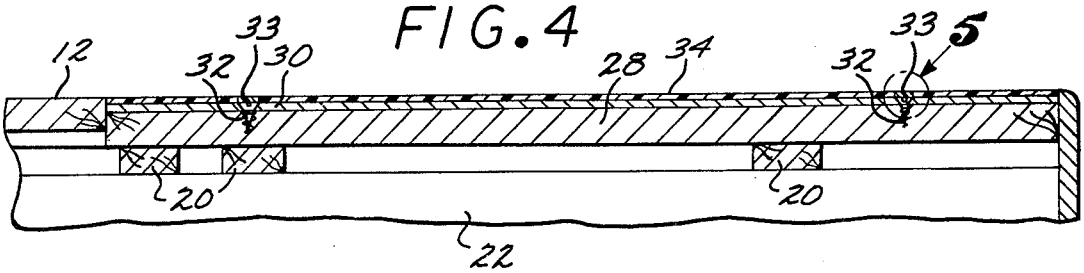
FIG. 4 is an enlarged cross sectional view taken in the direction of lines 2—2 of FIG. 1 illustrating a further step in the method of installation.

When the pin deck construction of the present invention is to be installed on an existing dented or otherwise worn pin deck, the original pin deck 14 is severed from the lane 12 by a transverse saw cut 35 and removed off the stringers 20 (FIGS. 2 and 3). Alternatively, the top surface of such deck may be routed out down to a depth of about ⅜ to 7/16 inches. In the case of the severed deck 14 shown, the ½ inch thick sound insulation layer 24 is replaced with a thinner sound insulation layer 36 of about ⅛ inch thick and either the deck section 14 returned thereto, or a prefabricated barrier cover lamination of similar thickness substituted therefor, thus leaving the top surface thereof about ⅜ inch below the top surface of the lanes. The top surface of such deck section 14 may then be sanded to even out any irregularities that may prevent secure bonding to the top surface thereof. While barrier and finishing layer laminate may be prefabricated, when laminated at the resurfacing site, barrier plate 30, as shown in FIG. 4, of relatively hard material such as steel, aluminum or hard plastic, is adhesively bonded to the top surface of the original deck section 14 and additionally secured by means of screws 39. A high pressure laminate layer 34 having a thickness equal to the depth of material removed by sanding is then adhesively bonded to the upper surface of the barrier plate 30.

The high pressure laminate layer 34 may be of any desired appearance, such as of a decorative color, and is shown in the preferred embodiment as commercially available PERMA-LANE, manufactured by General Electric. The laminate layer 34 has an external melamine surface which resembles the original appearance of the laminated wooden deck 14 (FIG. 2) of a conventional pin deck. Thus, the pin deck construction in accordance with the present invention utilizes the hard surface layer of the high pressure laminate 34 over the barrier plate 30 which is relatively rigid as compared to the original deck 14 normally constructed of loosely joined together tongue and groove slats 41. Further, such barrier plate 30 is impervious to oil absorbed in and between the slats 41 as a result of repeated dressing thereof, to greatly lessen deterioration of the adhesive layer between the laminate 34 and the barrier 30.

A pin deck originally constructed in accordance with the present invention is illustrated in FIG. 4. In this case, a hardwood base 28 of relatively inexpensive construction rests on the stringers 20. Overlying the somewaht flexible hardwood base 28 is a lamination of rigid barrier plate 30 of material such as steel, aluminum or hard plastic covered by a finishing layer 34.

Figure 5:
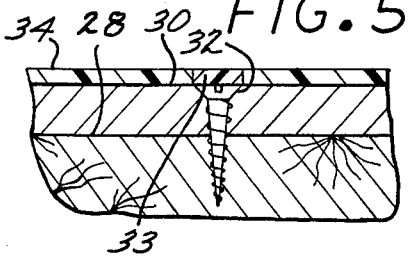
FIG. 5 is an enlarged fractional sectional view illustrating a fastening technique utilized in the present invention.

The barrier plate not only forms a relatively rigid support for distributing point contact forces over greater areas of the base 28, but acts as a barrier against indentation as a result of pin impact on the covering layer of high pressure laminate 34, as described hereinabove. When the barrier 30 and finishing layer 34 are prefabricated, they are cemented together at the factory and bores drilled therethrough in a selected pattern. Such bores are countersunk through the layer 34 for passage therethrough of the heads of anchor screws 32 (FIG. 5). The cover laminate 34 is bonded to the top surface of the barrier plate 30 by means of rubber based contact cement and may, itself, be replaced in the event of deterioration of the top surface thereof. At the site, bores may be drilled in the base 28 using the laminated barrier and cover layer 34 as a jig. The laminated barrier and cover are cemented to the base 28 and the anchor screws 32 inserted. The heads of the screws 32 are then covered by plugs 33 of high pressure PERMA-LANE to provide a continuous attractive finish.

Thus, an an original construction or as a method for installing the pin deck construction on an existing deck, the construction and method of the present invention provides a pin deck surface which takes advantage of the impact-resistant qualities of the high pressure covering laminate 34, as combined with the underlying barrier plate 30 which acts to support such covering laminate against dents and to distribute the point forces developed by rebounding pins over a greater area of the relatively flexible base 28, thus creating a pin action normally associated with pin action resulting from rebound onto the comparatively expensive tongue and groove joined slat construction of typical bowling alley pin decks.

While a preferred embodiment of the pin deck construction and method for installing the construction on existing pin decks has been described in detail above, it should be appreciated that alternate materials, dimensions and techniques may be employed so that the invention is not to be limited except by the following claims.

I claim:

1. A pin deck construction for supporting and intercepting rebounding bowling pins at one end of a bowling alley and comprising:

a frame;

a lane section on said frame and formed with an upwardly facing lane surface;

a pin deck base layer supported on said frame adjacent one end of said lane section and having a pin deck base layer top surface dentable by said rebounding bowling pins striking same and being disposed a predetermined distance below the surface level of said lane section;

a metal or plastic barrier plate overlying and affixed to the upper surface of said base layer, said barrier plate being constructed of a material of sufficient rigidity and thickness to cause the top surface thereof to be substantially undentable by said rebounding bowling pins and exhibit a greater resistance to denting thereby than said pin deck base layer top surface;

a high pressure finishing layer laminate overlying said barrier plate and including a top surface layer having a decorative finish; and, bonding means bonding said finishing layer laminate to the upper surface of said barrier plate, the combined thickness of said barrier plate and said finishing layer being substantially equal to said predetermined distance to dispose the top surface such finishing layer laminate level with the top surface of said upwardly facing lane surface whereby a bowling ball will roll down said lane section and onto said pin deck to strike bowling pins setting thereon and said pins rebounding onto said pin deck will impact said finishing layer and said barrier plate will resist indentation and consequent relative movement and breaking of the bond between said finishing layer and barrier plate.

2. The pin deck construction of claim 1, wherein:

said barrier plate is further anchored to said base layer by means of mechanical fastening means.

3. The pin deck construction as defined in claim 1, wherein:

said finishing layer laminate is constructed of melamine.

4. The pin deck construction as defined in claim 3, wherein:

said barrier plate is further anchored to the surface of said base layer by means of screws; and said barrier plate is constructed of metal.

5. The pin deck construction as defined in claim 1 wherein:

said barrier plate is constructed of aluminum.

6. A method for installing a synthetic laminate-type layer in a bowling alley pin deck disposed at one extremity of a bowling alley incorporating an original wooden top surface level with the top surface of an original lane section, comprising the steps of:

removing the wooden top surface of said deck forwardly to a line defining the end of said pin deck adjacent one end of said lane section;

positioning a deck base layer adjacent said one end of said lane section to dispose a lowered deck top surface in a horizontal plane a predetermined distance below the level of the top surface of said lane section;

selecting a barrier plate of a selected thickness and constructed of a metal or plastic material which is, at said selected thickness, substantially undentable by said rebounding bowling pins and offers a greater resistance to denting thereby than said lowered deck top surface;

affixing said barrier plate in overlying position on said lowered deck top surface of said base layer; and, adhesively bonding a synthetic finishing layer laminate to the top surface of said barrier plate, said finishing layer being constructed of a high pressure laminate material with an integral top surface layer having a decorative appearance, the combined thicknesses of said barrier plate and finishing layer being substantially the same as said predetermined distance whereby bowling pins impacting said finishing layer will be resisted from denting said barrier plate thereby maintaining the integrity of the bond of said finishing layer to said top surface of said deck base layer.

7. The method defined in claim 6, including the step of:

further affixing said barrier plate to said base layer by means of mechanical fasteners.

8. The method defined in claim 6, wherein:

said barrier plate selection step includes utilizing a barrier layer material which is substantially oil-impervious.

9. A method as set forth in claim 6 wherein:

said step of affixing said barrier plate is preceeded by forming a plurality of bores through said barrier plate and said affixing step includes inserting screws through said bores and into said deck base layer.

10. A method as set forth in claim 6 wherein:

said step of bonding said finishing layer to said barrier plate preceeds affixing said barrier plate to said base layer and is followed by the step of pre-drilling bores through said finishing layer and barrier plate and said affixing step includes inserting screws through said pre-drilled bores, screwing them into said base layer and then covering the heads of said screws.

11. The pin deck construction as defined in claim 6 wherein:

said step of selecting said barrier plate includes the step of selecting a aluminum barrier plate.

12. A method for installing a laminate type outer surface for a bowling alley pin deck with an original wooden top surface disposed level with an adjacent lane section, comprising the steps of:

lowering the wooden top surface by severing said deck along a transverse line from said lane section and lowering said entire original pin deck on said frame to a plane disposed a predetermined distance below the level of said lane section to provide a base layer;

adhesively bonding a barrier plate to the outer surface of said base layer; and adhesively bonding a finishing layer to the top surface of said barrier plate, said finishing layer being constructed of a high pressure laminate material with an integral external surface layer having substantially the appearance of said original top surface, the combined thicknesses of said barrier layer and finishing layer being substantially the same as said predetermined distance.

13. The method of claim 12 wherein said bowling alley includes an original sound insulation layer of selected thickness underneath said original pin deck and wherein:

said step of lowering said original deck includes the step of severing said original deck from said lane, removing said insulation layer, replacing said insulation layer with a thinner insulation layer having a thickness thinner than said original insulation by a distance that, when combined with the thickness of said barrier plate, is equal to said predetermined distance.

* * * * *